US010242628B2

(12) United States Patent
Lee et al.

(10) Patent No.: US 10,242,628 B2
(45) Date of Patent: Mar. 26, 2019

(54) LIGHT EMITTING DIODE (LED) BACKLIGHT CONTROL FOR REPRODUCTION OF HIGH DYNAMIC RANGE (HDR) CONTENT USING STANDARD DYNAMIC RANGE (SDR) LIQUID CRYSTAL DISPLAY (LCD) PANELS

(71) Applicant: Dell Products, L.P., Round Rock, TX (US)

(72) Inventors: Siew Fei Lee, Singapore (SG); Vui Khen Thien, Singapore (SG)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 15/599,404

(22) Filed: May 18, 2017

(65) Prior Publication Data

US 2018/0336846 A1 Nov. 22, 2018

(51) Int. Cl.
*G09G 3/36* (2006.01)
*G09G 3/34* (2006.01)

(52) U.S. Cl.
CPC ..... *G09G 3/3406* (2013.01); *G09G 3/36* (2013.01); *G09G 2320/0247* (2013.01); *G09G 2320/041* (2013.01); *G09G 2320/0646* (2013.01); *G09G 2320/0653* (2013.01); *G09G 2320/0666* (2013.01); *G09G 2360/16* (2013.01)

(58) Field of Classification Search
CPC ..... G09G 3/3406; G09G 3/36; G09G 2320/0666; G09G 2320/0653; G09G 2360/16; G09G 2320/0646; G09G 2320/041; G09G 2320/0247
See application file for complete search history.

(56) References Cited

U.S. PATENT DOCUMENTS

| | | | | |
|---|---|---|---|---|
| 9,124,851 | B2 * | 9/2015 | Akita | G02F 1/13306 |
| 9,635,377 | B2 * | 4/2017 | Kim | H04N 19/463 |
| 2015/0245043 | A1 * | 8/2015 | Greenebaum | H04N 21/42202 375/240.25 |
| 2016/0322020 | A1 * | 11/2016 | Park | G09G 3/2003 |
| 2016/0358346 | A1 * | 12/2016 | Hendry | G09G 5/02 |
| 2017/0287120 | A1 * | 10/2017 | Sato | G06T 5/007 |
| 2017/0293205 | A1 * | 10/2017 | Iwata | G03B 17/18 |
| 2018/0255225 | A1 * | 9/2018 | Yu | H04N 5/202 |

* cited by examiner

*Primary Examiner* — Rodney Amadiz
(74) *Attorney, Agent, or Firm* — Fogarty LLP

(57) ABSTRACT

Systems and methods for Light Emitting Diode (LED) backlight control for reproduction of High Dynamic Range (HDR) content using Standard Dynamic Range (SDR) Liquid Crystal Display (LCD) panels. In an illustrative, non-limiting embodiment, an LCD display may include: an SDR-LCD panel and a controller coupled to the SDR-LCD panel, the controller configured to: identify video that includes HDR content using a luminance histogram, and to display the HDR content by increasing a luminance of a Light-Emitting Diode (LED) backlight disposed within the LCD display.

18 Claims, 6 Drawing Sheets

LIGHT EMITTING DIODE (LED) BACKLIGHT CONTROL FOR REPRODUCTION OF HIGH DYNAMIC RANGE (HDR) CONTENT USING STANDARD DYNAMIC RANGE (SDR) LIQUID CRYSTAL DISPLAY (LCD) PANELS

FIELD

This disclosure generally relates to Information Handling Systems (IHSs), and, more particularly, to systems and methods for Light Emitting Diode (LED) backlight control for reproduction of High Dynamic Range (HDR) content using Standard Dynamic Range (SDR) Liquid Crystal Display (LCD) panels.

BACKGROUND

As the value and use of information continue to increase, individuals and businesses seek additional ways to process and store information. An option is an Information Handling System (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use, such as financial transaction processing, airline reservations, enterprise data storage, global communications, etc. In addition, IHSs may include a variety of hardware and software components that may be configured to process, store, and communicate information; and may include one or more computer systems, data storage systems, and/or networking systems.

In some implementations, an IHS may be coupled to one or more screens, displays, monitors, televisions, or the like; such as, for example, a Liquid Crystal Display (LCD) monitor. In operation, an LCD display may enable an IHS to render images and video to an end-user. While conventional LCD displays have been designed to show Standard Dynamic Range (SDR) content, modern monitors can also display content having High Dynamic Range (HDR). In most implementations, HDR-capable displays are "backwards-compatible," and can also reproduce SDR images or movies.

As the inventors hereof have recognized, however, conventional SDR-LCD displays, which are designed only to present SDR content, cannot properly reproduce HDR content. To address these, and other concerns, the inventors hereof have developed systems and methods for LED backlight control for reproduction of HDR content using SDR-LCD panels.

SUMMARY

Embodiments of systems and methods for Light Emitting Diode (LED) backlight control for reproduction of High Dynamic Range (HDR) content using Standard Dynamic Range (SDR) Liquid Crystal Display (LCD) panels. In an illustrative, non-limiting embodiment, an LCD display may include: an SDR-LCD panel and a controller coupled to the SDR-LCD panel, the controller configured to: identify video that includes HDR content using a luminance histogram, and to display the HDR content by increasing a luminance of a Light-Emitting Diode (LED) backlight disposed within the LCD display.

In some embodiments, the video may include: (a) a first portion of HDR content having a luminance below a given value, and (b) a second portion of HDR content having a luminance above the given value; and displaying the HDR content may further includes: (a) boosting the luminance of the SDR-LCD panel to the first luminance value while the first portion is being displayed, and (b) boosting the luminance of the SDR-LCD panel to the second luminance value for a duration of time shorter than a total duration of the second portion.

Boosting the luminance may include applying, to the LED backlight, an amount of electrical current above a normal operating range, where the amount of electrical current decreases a lifespan of the LED backlight faster than any other amount of electrical current within the normal operating range. Additionally or alternatively, boosting the luminance may include increasing the luminance by a discrete increment.

In some cases, the video may include a first portion and a second portion, the first portion does not include any HDR content and the second portion includes the HDR content, and the discrete increment may prevent flashing or blinking of the SDR-LCD panel between the displaying of the first portion and the displaying of the second portion.

The discrete increment may produce a luminance value derived as: (a) a luminance value of a current frame multiplied by a weighted coefficient; plus (b) one minus the weighted coefficient, multiplied by a luminance value of a previous frame. The weighted coefficient may be a combination of: a temperature-based coefficient, a scene-based coefficient, and a time-based coefficient.

The controller may be configured to: determine that a thermal overrun event has occurred; and decrease the luminance of the SDR-LCD panel by another discrete increment using a temperature-based coefficient while the video continues to include the HDR content. Additionally or alternatively, the controller may be configured to determine that an overdrive timeout event has occurred, and to decrease the luminance of the SDR-LCD panel by another discrete increment using a time-based coefficient. Additionally or alternatively, the controller may be further configured to: determine that a thermal overrun event has not occurred; determine that an overdrive timeout event has not occurred; and increase the luminance of the SDR-LCD panel by another discrete increment based on a scene-based coefficient.

In another illustrative, non-limiting embodiment, a method may implement one or more of the aforementioned operations. In yet another illustrative, non-limiting embodiment, a hardware memory device may have program instructions stored thereon that, upon execution by an IHS, cause the IHS to perform one or more of the aforementioned operations.

BRIEF DESCRIPTION OF THE DRAWINGS

The present invention(s) is/are illustrated by way of example and is/are not limited by the accompanying figures. Elements in the figures are illustrated for simplicity and clarity, and have not necessarily been drawn to scale.

DETAILED DESCRIPTION

Figure 1:
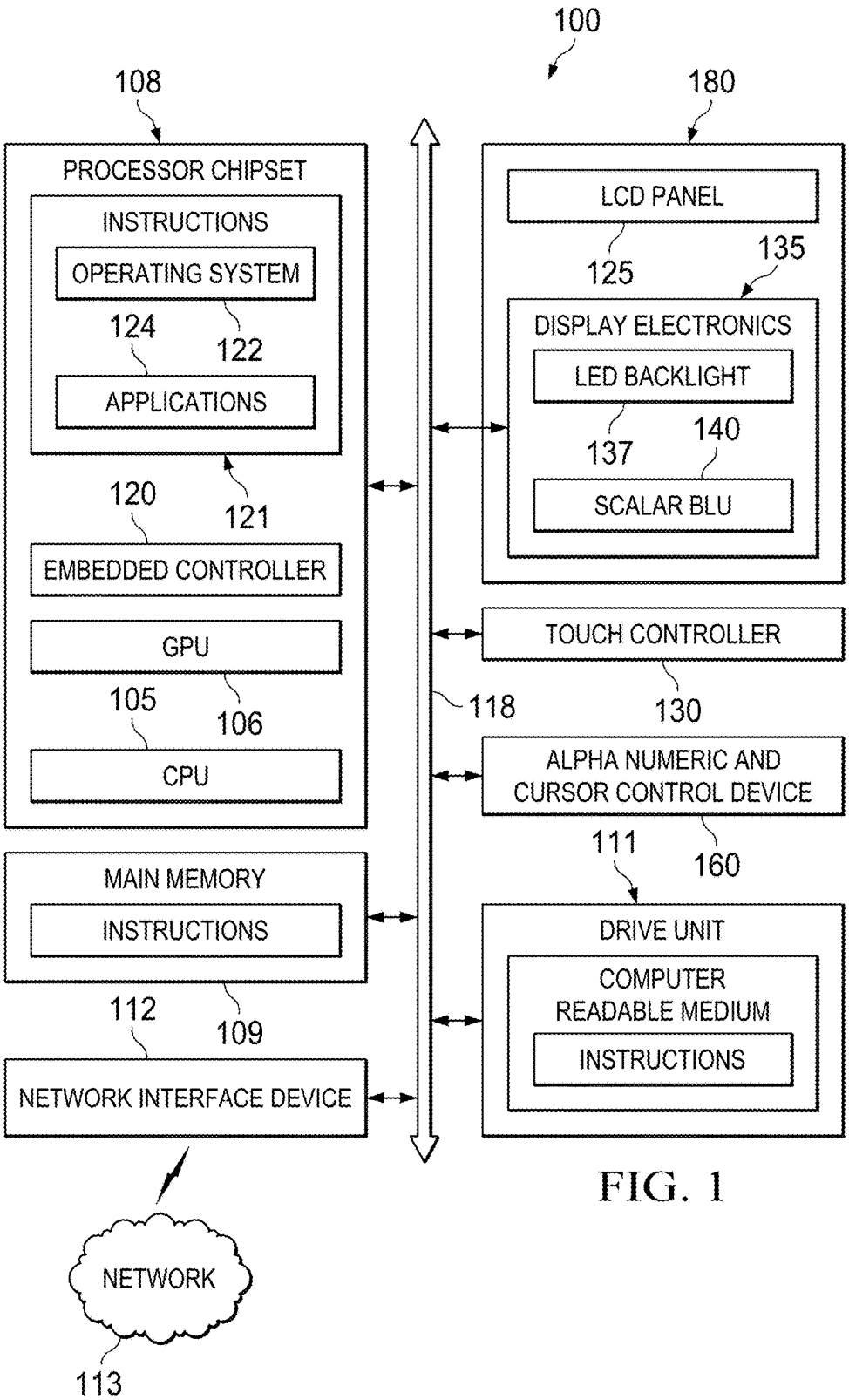
FIG. 1 is a diagram illustrating an IHS coupled to an LED-backlit LCD display and configured according to some embodiments.

Systems and methods described herein may employ techniques for Light Emitting Diode (LED) backlight control for reproduction of High Dynamic Range (HDR) content using Standard Dynamic Range (SDR) Liquid Crystal Display (LCD) panels. These systems and methods may provide a "bridging" solution to allow HDR content to be experienced by an end-user most of the time (e.g., ~90% of the time), meeting one or more of HDR's stringent hardware requirements (e.g., true 4K resolution, true BT.2020 color gamut, and/or true local dimming for the largest screen contrast between the darkest and brightest pixels) using otherwise conventional SDR-LCD panels.

The terms "Standard Dynamic Range" or "SDR," as used herein, describe the dynamic range of images, rendering, and/or video that uses a conventional gamma curve, which allows for a maximum luminance of 100 cd/m$^2$ (candela per square meter, also referred to as "nits"). Conversely, the terms "High Dynamic Range" or "HDR," as used herein, refer to dynamic range(s) that are orders of magnitude greater than SDR. For example, when using a conventional gamma curve and a bit depth of 8-bits per sample, SDR video has a dynamic range of about 6 stops (64:1). Conversely, when HDR content is displayed on a 2,000 cd/m$^2$ display with a bit depth of 10-bits per sample, its dynamic range is 17.6 stops (200,000:1).

Systems and methods described herein may implement Light Emitting Diode (LED) backlight control techniques for displaying HDR content using an SDR, Light-Emitting Diode (LED)-backlit Liquid Crystal Display (LCD) panel, for example, by overdriving the LED backlight with electric currents beyond typical or manufacturer-recommended operating ranges, and then controlling the LED backlight to meet luminance criteria of HDR while ensuring that the LCD display operates within its capability, safety, and reliability requirements (e.g., thermal, current, voltage, lamp life, etc.). As such, these systems and methods enable non-HDR LCD panels to meet luminance requirements of HDR content, most of the time, and at a fraction of the cost, with "on-demand" adjustment of luminance while maintaining the integrity of the system.

An LED-backlit LCD display employing one or more of systems and methods described herein may yield as much as 500 nits (or more) without concern of overheating and causing electrical failures to its pixels, sub-structures or components. (In contrast, conventional LCD displays that do not use these systems and methods can only typically support up to 250 nits, which is well below HDR requirements.) While maintaining the same cost of build for the SDR-LCD panel, embodiments described herein may increase or "boost" the electrical current or power provided to the LED backlight, and it may then lower the electrical current or power to reduce the luminance dynamically and/or incrementally, based on at least one of three criteria or factors: (1) temperature tolerance, (2) HDR content, and/or (3) time duration. In many cases, use of all three criteria has proven to be particularly suitable for moving images with HDR content having high-luminance requirements.

For example, an LED backlight's brightness may be increased as required to display HDR content using a luminance histogram distribution captured in real-time (e.g., via a "scalar" or display controller). To protect the LCD display against thermal runaway, a temperature sensor may be deployed at or near the LED backlight (e.g., in proximity to a backlighting driving circuit, or other suitable location within the display). The detected temperature may be fed back to the display's scalar board or controller, which, in turn, can reduce the power or electrical current provided to the LED backlight as necessary to avoid damage.

To further regulate heat generated by a boosted LED backlight, a time sensitive "booster period" may be used to limit the duration of the boost. Additionally or alternatively, to avoid sudden flashes of light due to the boosted LED backlight, certain embodiments described herein may incorporate a low-pass technique suitable for controlling sensitivity in response to the brightness requirements of HDR and reliability of the backlight.

In various implementations, the HDR effect produced using the systems and methods described herein may be visible extending from 250 nits to 400 nits or beyond, and yet the LED reliability Mean-Time-To-Failure (MTTF) can still be maintained at its normal range (e.g., 20-30K hours). These implementations are well-suited for content consumption from varied HDR source devices (e.g., network streaming, televisions, HDR players, IoT devices, mobile devices, etc.) that would not otherwise carry sufficient HDR processing power. Using the systems and methods described herein, an end-user may enjoy the visual experience of various HDR sources on wide variety of LED-backlit LCD displays.

Turning now to FIG. 1, a diagram illustrating an IHS coupled to an LED-backlit LCD display is depicted. In various embodiments, IHS 100 may include processor chipset 108 having at least one CPU 105. For example, CPU 105 may be a general-purpose processor or controller implementing any of a variety of Instruction Set Architectures (ISAs), such as the x86, POWERPC®, ARM®, SPARC®, or MIPS® ISAs, or the like. In multi-processor systems, each of CPU(s) 105 may commonly, but not necessarily, implement the same ISA. Chipset 108 may also include Graphics Processing Unit (GPU) 106 and embedded controller 120.

IHS 100 may include several sets of instructions 121 to be executed by CPU 105, GPU 106, and/or embedded controller(s) 120. One such set of instructions includes Operating System (OS) 122 with an graphical interface displayable by LCD display 180. In addition, IHS 100 may further execute other sets of instructions in the form of multiple software applications 124, which can enable multiple uses of IHS 100.

In some cases, IHS 100 may operate as a standalone device or may be connected to other computer systems or peripheral devices. IHS 100 can represent a server device whose resources can be shared by multiple client devices, or it can represent an individual client device, such as an individual mobile personal computing system.

In this non-limiting example, CPU 105 is configured to execute code stored in memory 109. Additional components of IHS 100 may include one or more storage devices such as drive unit 111. Main memory 109 and/or drive unit 111 may use any suitable memory technology, such as static RAM (SRAM), synchronous dynamic RAM (SDRAM), non-volatile or Flash memory, magnetic rotating disks (HDDs), or any other type of hardware memory storage device. Each of devices 109 and 111 may include a computer readable medium with instructions or data stored thereon.

Other components of IHS 100 may include one or more communications ports for communicating with external devices as well as various input and output (I/O) devices via one or more buses 118. Examples of I/O devices include alphanumeric and cursor control devices 160 such as a keyboard, a touchpad, a mouse, touch controllers 130, etc. In some cases, drive unit 111, device 160, and/or touch controller 130 may be internal or external devices coupled to IHS 100 via bus 118.

In many instances, bus or port 118 may implement various versions of Universal Serial Bus (USB), High-Definition Multimedia Interface (HDMI) protocol, DisplayPort, Mobile High-definition Link (MHL), or the like. Network interface device 112 may include a wireless cellular or mobile networks (CDMA, TDMA, etc.), WIFI, WLAN, LAN, or similar network connection, enabling a user to communicate via a wired or wireless communications network 113, such as the Internet.

In various embodiments, IHS 100 may be coupled to monitor 180 via bus 118 using display electronics 135. Display electronics 135 may include SDR-LCD panel 125 and LED backlight 137, as well as scalar board and backlight controller unit (BLU) 140, among other components. In operation, video or image signals received from processor chipset 108 (e.g., from GPU 106) may be processed by scalar board and BLU 140, and then displayed by monitor 180 via SDR-LCD panel 125 using LED backlight 137. LED backlight 137 typically sits behind SDR-LCD panel 125 within an enclosed chassis, and it outputs a controllable amount of light to produce a luminance effect controllable by scalar board and BLU 140.

Figure 2:
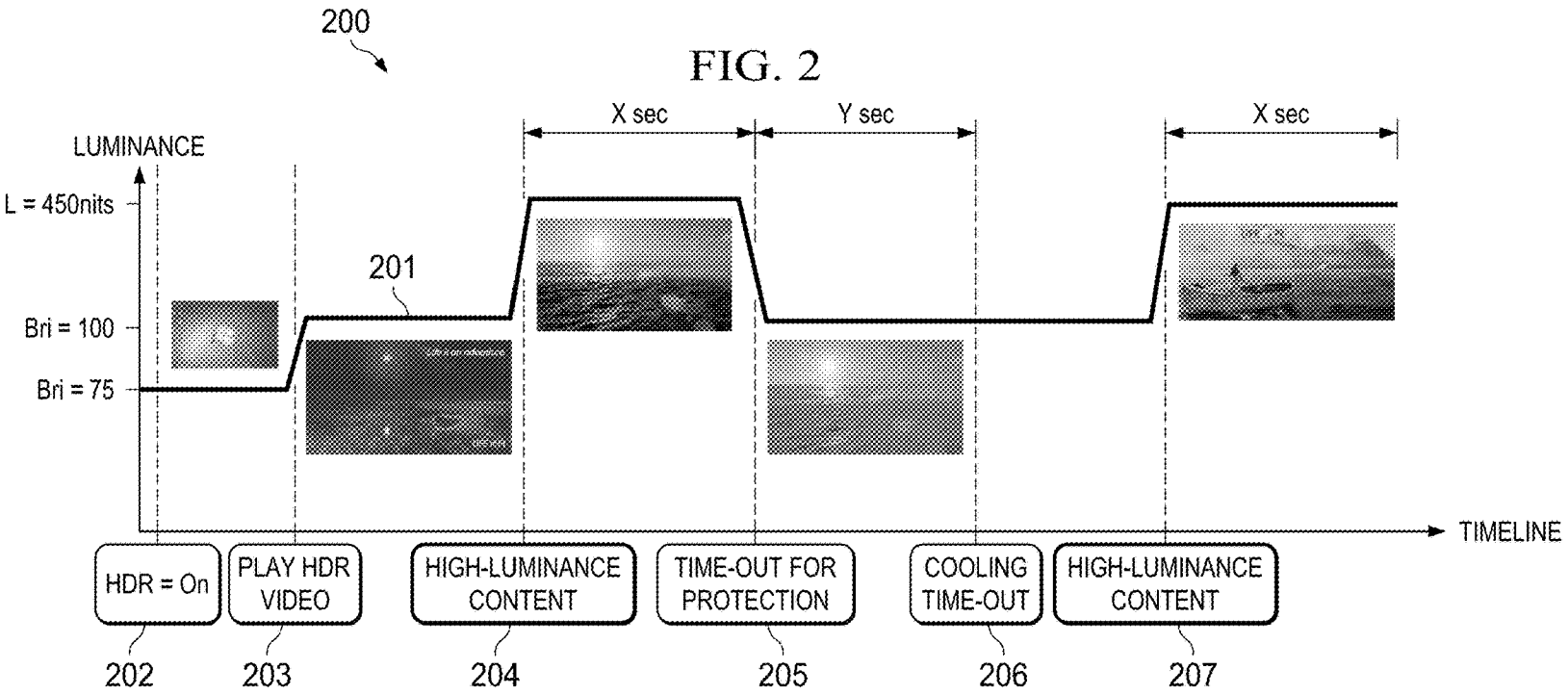
FIG. 2 is a timeline illustrating operation of an LED-backlit LCD display according to some embodiments.

FIG. 2 is a timeline illustrating operation of an LED-backlit LCD display according to some embodiments. In some cases, an LED-backlit LCD display may be coupled to any type of IHS. In other cases, the LED-backlit LCD display may be a television set or the like, and an IHS may be coupled to or integrated into the television.

Curve 201 shows how luminance changes over time in this specific, non-limiting example. Initially, at time 202, the luminance of the LCD display is at 75 nits, and the HDR effect is turned on. For example, a signal received by scalar board and BLU 140 from GPU 106 may include metadata that indicates the (at least potential) presence of HDR content in a video stream. At time 203, the LCD screen begins displaying HDR video, and the luminance of the LCD screen is increased to 100 nits.

Then, at time 204, the LCD display receives high-luminance HDR content, and the luminance of the LCD display is boosted up to 450 nits for X seconds. After X seconds, which may be used as a time-out for protection of the LCD display, the luminance is reduced at time 205 back to 100 nits.

Between times 205 and 206, the LCD display is allowed Y seconds to cool down. Between times 206 and 207, HDR video continues to be displayed at 100 nits. At time 207, however, high-luminance HDR content is again received, and the luminance of the LCD display is again boosted to 450 nits for X seconds.

Figure 3:
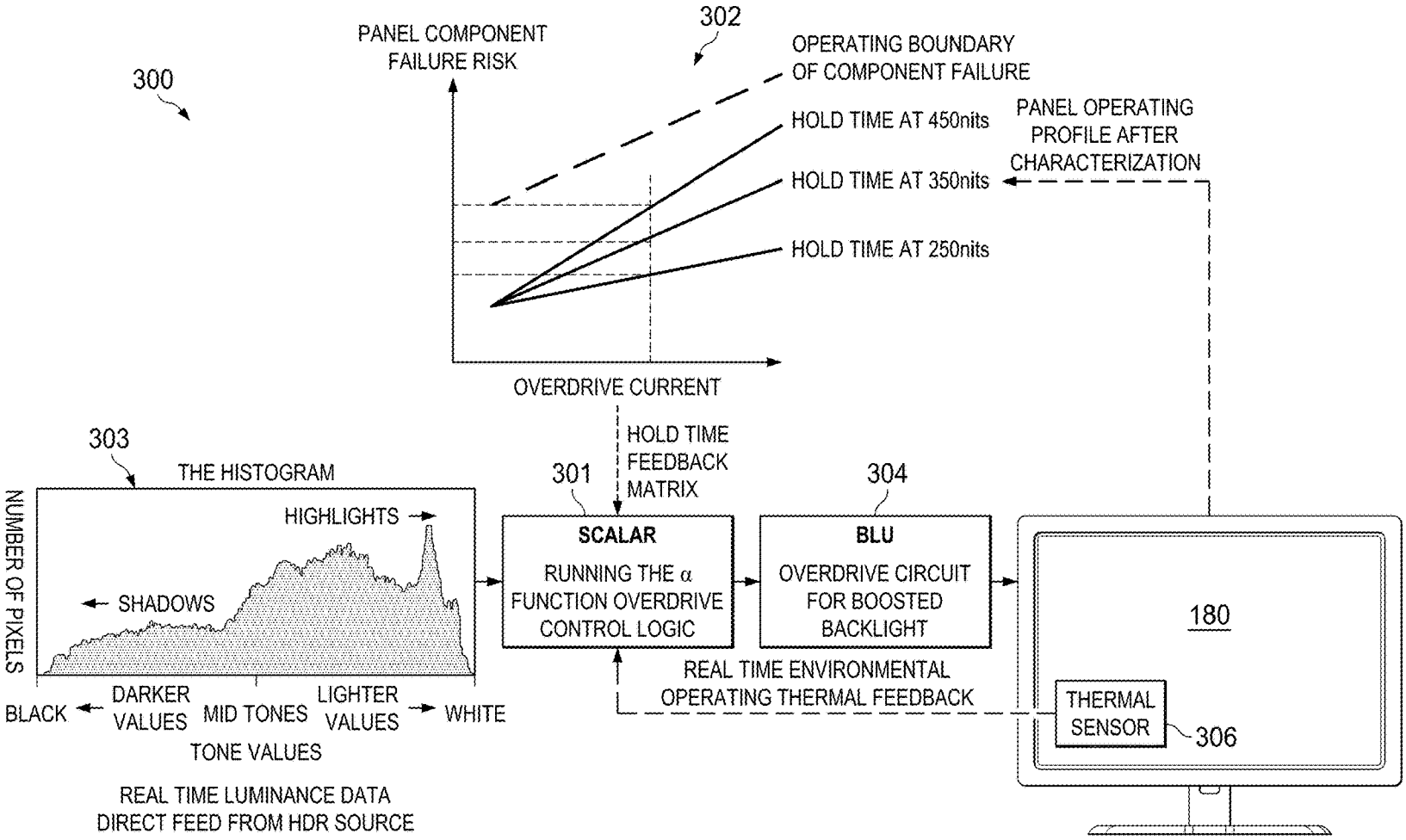
FIG. 3 is a diagram illustrating a system for LED-backlight control according to some embodiments.

FIG. 3 is a diagram illustrating a system for LED-backlight control according to some embodiments. In this example, scalar board or circuitry 301 is shown distinct from BLU 304. (In FIG. 2, these components were combined into single element 140 for ease of explanation.) Components 301 and 304, as well as temperature sensor 306, may be disposed within LCD display 180.

Upon and/or during manufacturing of LCD display 180, an empirical process may be performed to characterize the display when LED backlight 137 is overdriven by BLU 304 under control of scalar 301, for example, in response to scalar 301 attempting to display an HDR signal received from GPU 106 at various luminance levels using SDR-LCD panel 125. As a result of the characterization, hold time characterization chart or matrix 302 is created that indicates the risk of component failure in response to an overdrive current provided from BLU 304 to LED backlight 137 for different hold times (different time durations for which a respective luminance value is maintained).

Scalar 302 may then employ operating profile 302 to avoid reaching the operating boundary of component failure for different hold times and for different luminance values (e.g., 250, 350, 450 nits, etc.) as the control logic within scalar 301 and/or BLU 304 to overdrive LED backlight 137 to create a visual HDR effect to the end-user. Moreover, temperature measurements from temperature sensor 306 may be used to provide real-time environment operating feedback.

During operation, scalar 301 may receive or generate histogram 303 that shows, for the total number of pixels in SDR-LCD panel 125, a distribution of real-time luminance data received from an HDR source (e.g., GPU 106). In this example, histogram 303 shows highlights on the right-end side and shadows on the left-hand side. The vertical axis indicates the number of pixels having black values (all the way to the left), white values (all the way to the right), and midtones (in the middle). Generally, darker pixels are accounted for on the left side of the midtones, and lighter pixels are accounted for on the right of the midtones.

Using histogram 303, scalar 301 may also determine whether any frame in a received HDR signal has high or low-luminance content, based upon a selected threshold value (e.g., 100 nits and above, 250 nits and above, etc.). In some cases, the control logic within scalar 301 and/or BLU 304 may overdrive LED backlight 137, in response to a determination that the HDR signal has high-luminance content, as it does between times 204 and 205 in FIG. 2, for example.

Once the characterization is performed, the following "luminance equation" may be used to apply incremental luminance variations, whether to increase or to decrease the luminance provided by the overdriving of the LED backlight, as the video signal transitions between HDR and SDR content and/or between high-luminance and low-luminance HDR content:

$$L_{n+1}=\alpha L_n+(1-\alpha)L_{n-1} \qquad \text{Equation 1}$$

where n indicates a current video frame, such that $L_n$ represents the luminance of a current frame (e.g., a maximum value, average value, etc.), $L_{n+1}$ represents the luminance of a subsequent frame, to be displayed immediately (or as soon as possible) after the current frame.

In the luminance equation, $\alpha$ is a "weighted coefficient." Incremental luminance changes for subsequent frames may be derived as discrete luminance value increments (whether up or down) using as: (a) a luminance value of a current frame multiplied by the weighted coefficient $\alpha$; plus (b) one minus the weighted coefficient $\alpha$, multiplied by a luminance value of a preceding frame.

Moreover, $\alpha$ may be calculated as a combination of: a temperature-based coefficient ($\alpha_{Temperature}$), a scene-based coefficient ($\alpha_{Luminance}$), and a time-based coefficient ($\alpha_{Time}$). Each of these distinct coefficients implements a respective one of aforementioned criteria or factors, to recapitulate: (1) temperature tolerance, (2) HDR content, and (3) time duration, respectively.

The value of $\alpha$, also referred to as $\alpha_{Global}$, is (e.g., typically between 0.5 to 0.9), may be given as:

$$\alpha=F(k_1\alpha_{Temperature},k_2\alpha_{Scene\ Luminance},k_3\alpha_{Time}) \quad \text{Equation 2}$$

where values $k_1$-$k_3$ are adjustment factors or multipliers resulting from the characterization process. In many cases, $\alpha_{Temperature}$, $\alpha_{Luminance}$, $\alpha_{Time}$, $k_1$ (also referred to as $k_{Temperature}$), $k_2$ (also referred to as $k_{Luminance}$), and $k_3$ (also referred to as $k_{Time}$) may be empirically determined values that enable luminance of the LED backlight to reach HDR values for a particular SDR-LCD panel, without reaching the operating boundary of component failure of graph 302 in FIG. 3. These values may change depending upon the relative importance of each respective criteria or factor for a particular SDR-LCD panel, and can also change between different instances of the same SDR-LCD panel model and/or manufacturer.

Although these various coefficients, weights, and values may be empirically determined in a manufacturing or laboratory setting, persons of ordinarily skill in the art are capable of selecting values suitable for a particular LCD display, for example, by examining graph 302 after applying HDR signals (e.g., as shown in histogram 303) to the SDR-LCD panel 125 under control of scalar 301 and BLU 302.

Figure 4:
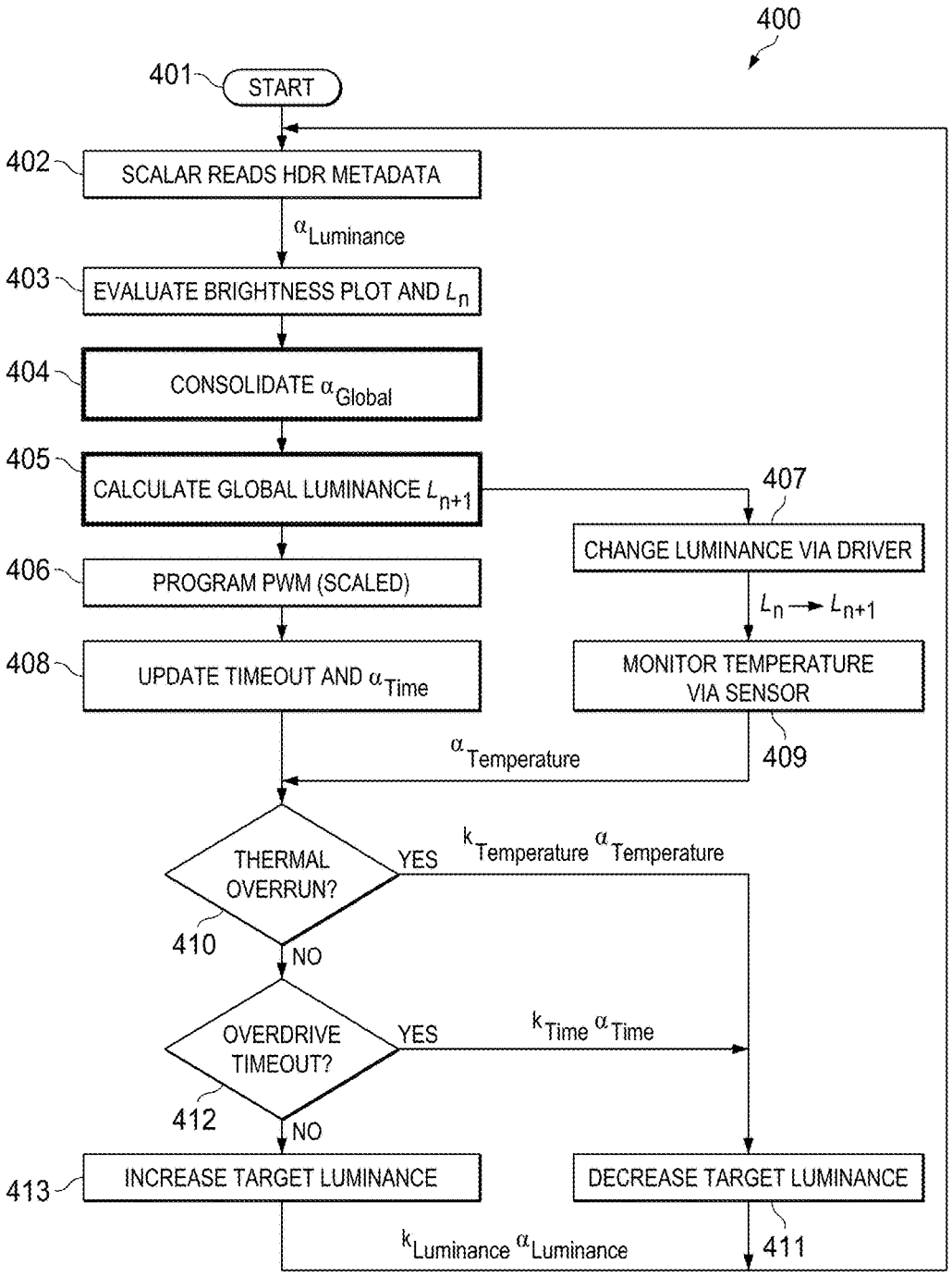
FIG. 4 is a flowchart illustrating operation of a method for LED-backlight control according to some embodiments.

FIG. 4 is a flowchart illustrating operation of a method for LED-backlight control. In some embodiments, scalar 301 and/or BLU 304 may perform method 400 in order to overdrive LED backlight 137 to properly reproduce HDR content, with an HDR effect, in an otherwise conventional SDR-LCD panel.

Method 400 begins at block 401. At block 402, scalar 301 reads HDR metadata from an HDR signal, which includes a value of $\alpha_{Lumminance}$, and passes that value to block 402, which evaluates a brightness plot, for example, in the form of histogram 303, and identifies an initial value for the luminance of a current frame ($L_n$). At block 404, method 400 calculates a consolidated "global" a value, also to as $\alpha_{Global}$ (shown as simply a in Equation 2).

At block 405, method 400 calculates a luminance for a subsequent frame of the video stream ($L_{n+1}$), for example, using Equation 1 above. At block 406, method 400 may program a scaled Pulse-Width-Modulated (PWM) signal to be applied to BLU 304. At block 408, method 400 updates the timeout value as well as $\alpha_{Time}$.

At block 407, BLU 304 may use the PWM signal to change the luminance of the LED backlight 304, for the current frame $L_n$, after which $L_{n+1}$ is calculated using Equation 1. And, at block 409, temperature data from temperature sensor 306 yields $\alpha_{Temperature}$.

At block 410, method 400 determines whether a thermal overrun in underway—e.g., the temperature meets (or is about to meet) a maximum recommended threshold. If so, $k_{Temperature}\times\alpha_{Temperature}$ is provided to block 411, which incrementally decreases the target luminance for the subsequent frame $L_{n+1}$ using Equation 1, and control returns to block 402. Otherwise, block 412 determines whether an overdrive timeout has occurred using hold time characterization chart or matrix 302. If so, $k_{Time}\times\alpha_{Time}$ is used by block 411 to incrementally decrease the target luminance for the subsequent frame $L_{n+1}$ using Equation 1, and control returns to block 402. Otherwise, block 413 calculates $k_{Luminance}\times\alpha_{Luminance}$, and incrementally increases the target luminance for the subsequent frame $L_{n+1}$ using Equation 1.

Figure 5:
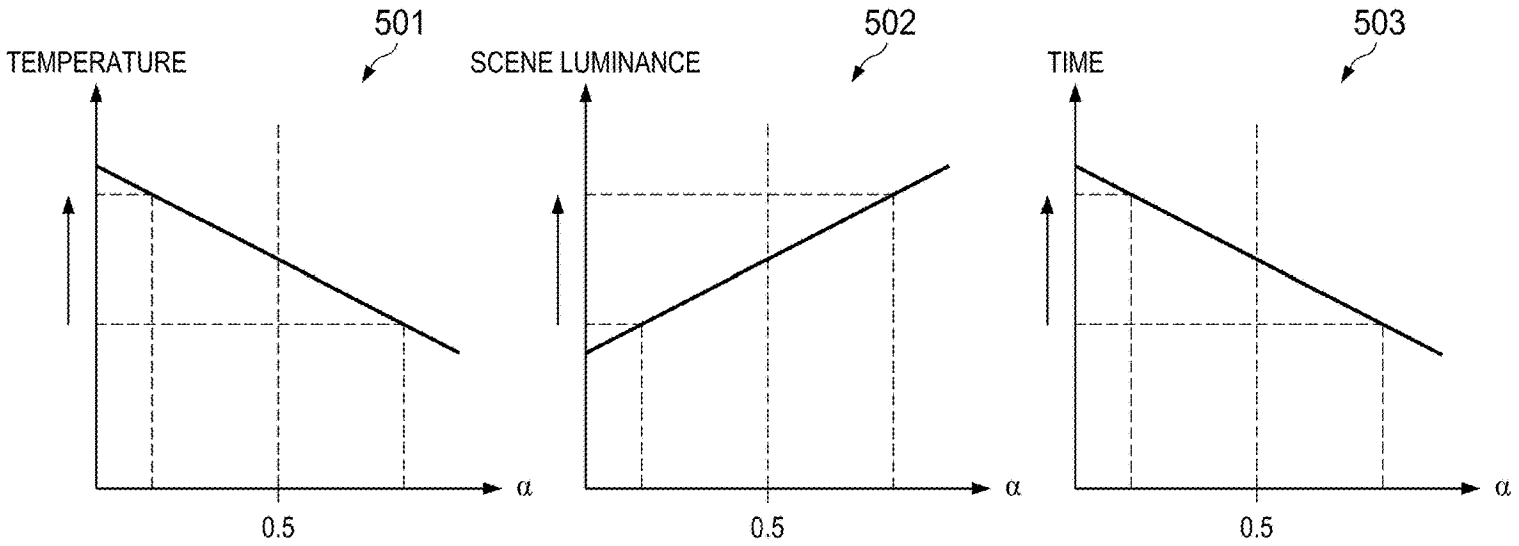
FIG. 5 is a graph illustrating temperature, scene luminance, and time coefficients usable to implement LED-backlight control techniques according to some embodiments.

FIG. 5 is a graph illustrating temperature, scene luminance, and time coefficients usable to implement LED-backlight control techniques. In various embodiments, temperature graph 501, scene luminance graph 502, and hold time graph 503 may be used to select values of $\alpha_{Temperature}$, $\alpha_{Luminance}$, and $\alpha_{Time}$, used in method 400, respectively.

Figure 6:
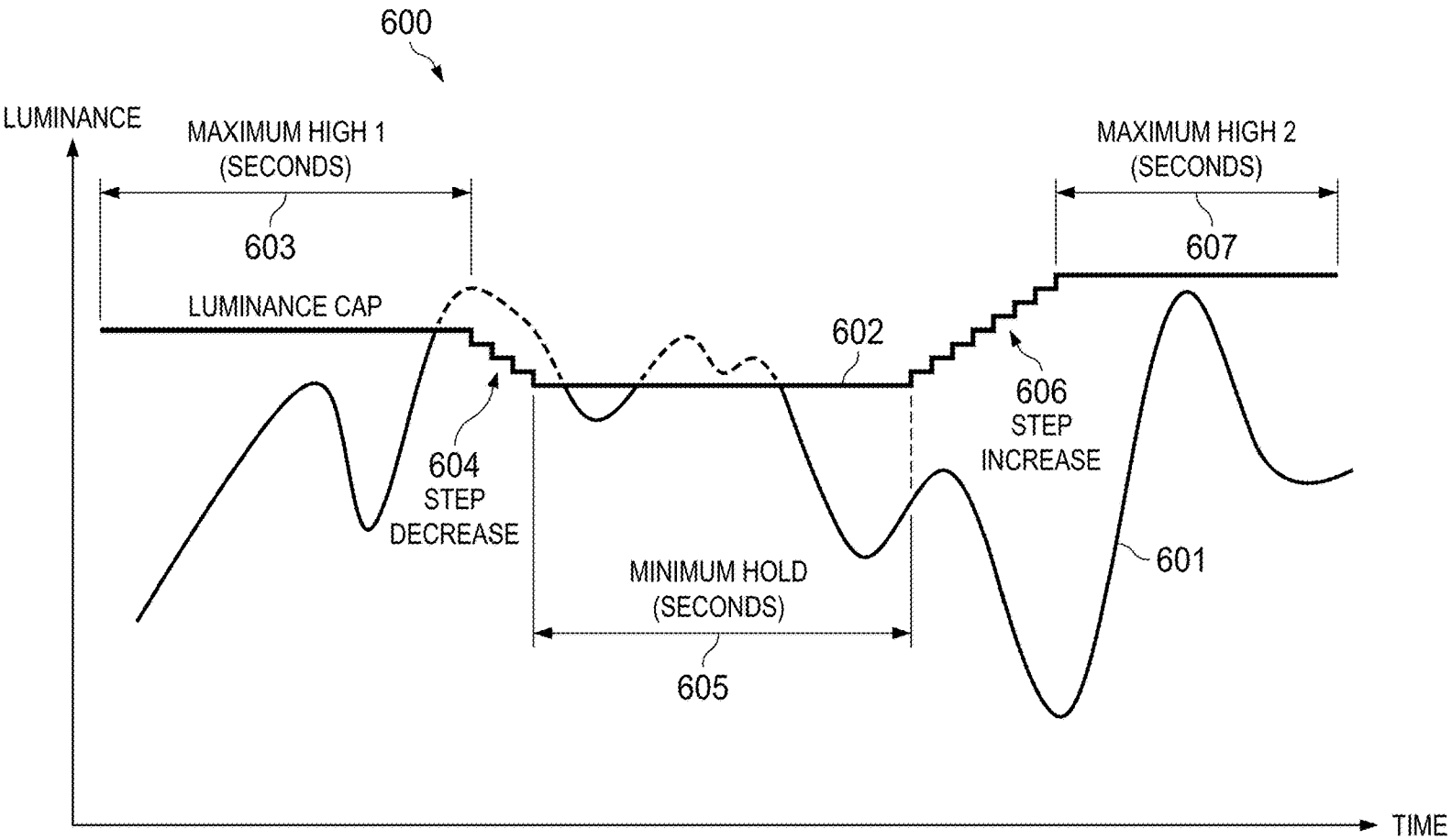
FIG. 6 is a graph illustrating how luminance may be controlled using LED-backlight control techniques according to some embodiments.

FIG. 6 is a graph illustrating how luminance may be controlled using LED-backlight control techniques. In this non-limiting example, curve 601 shows the luminance values requested by an HDR signal displaying a moving image, as well as a luminance cap curve or mask 602 that increases or decreases the brightness of the LED backlight using method 400.

During time 603, luminance cap mask 602 is maintained at a first maximum value, such that HDR signal's luminance 601 is properly reproducible by the LCD display through the overdriving of the LED backlight, until a temperature and/or hold time threshold is reached. At that point, and during time 604, luminance cap 602 is reduced incrementally, in discrete steps, as method 400 loops around and reaches block 411 (in this case, 4 times and/or for 4 frames). During time 604, the HDR luminance 601 is not allowed to overcome luminance cap 602.

It is noted that the dotted portion of HDR luminance 601 indicates that the luminance values requested or indicated in the HDR signal are not reached during time 604, but rather the luminance of the display is kept at the maximum values provided by the incrementally decreasing luminance cap 602, in order to avoid compromising the integrity of the LCD display, for example, due to thermal runaway or the like.

During time 605, luminance cap mask 602 remains at reduced value during a minimum hold time, for example, to allow the LED backlight to cool down. Here only a portion of HDR luminance 601 is dotted, to indicate that, during the dotted period, once again the luminance values requested or indicated in the HDR signal are not reached during time 604, but rather the luminance of the display is kept at the maximum, but now reduced value.

After time 605 and during time 606, luminance cap 602 is increased incrementally, in discrete steps, as method 400 loops around and reaches block 413 (in this case, 8 times and/or for 8 frames) to the maximum value used during time 603. Because the luminance requested or indicated in the HDR signal 601 behaves during time 607 (that is, it does not meet or overcome curve 602), that portion of the HDR signal is properly displayed by SDR-LCD panel 125 during that time without decreasing cap 602.

To further illustrate an example of an application of the various systems and methods described above, assume that, at any given time, $\alpha_{Luminance}$ may take any of three distinct values or levels (e.g., $\alpha_{Luminance\text{-}High}$, $\alpha_{Luminance\text{-}Mid}$, and $\alpha_{Luminance\text{-}Low}$), $\alpha_{Temperature}$ may take either of two distinct values or levels (e.g., $\alpha_{Temperature\text{-}High}$ and $\alpha_{Temperature\text{-}Low}$), and $\alpha_{Time}$ may also take either of two distinct values or levels (e.g., $\alpha_{Time\text{-}High}$ and $\alpha_{Time\text{-}Low}$). Actual numerical values for each of these may vary to suit empirical data for a specific SDR-LCD panel, particular models of SDR-LCD panel, etc. Also, assume that adjustment factors $k_{Luminance}=k_{Temperature}=k_{Time}=1$.

In some implementations, $\alpha$ values may be provided in the form of instruction levers that can be programmatically toggled into any one of the aforementioned values to influence the desired end state or result. An example matrix of α values is shown in Table I below, with the Result column obtainable using method 400 of FIG. 4:

TABLE I

| State | $\alpha_{Luminance}$ | $\alpha_{Temperature}$ | $\alpha_{Time}$ | Panel Condition | Response | $\alpha_{Global}$ | Result |
|---|---|---|---|---|---|---|---|
| 1 | High | Low | Low | Ideal/Normal Operating Condition | Luminance to remain true to the HDR content | 1.00 | $L_{n+1}$ |
| 2 | High | Low | High | Exceeded duration allowable to hold current luminance | Lower the luminance cap mask yet remain true to HDR content | 0.75 | $L_{mid}$ |
| 3 | High | High | Low | Overheated | Protect panel | 0.75 | $L_{lowest}$ |
| 4 | High | High | High | Overheated & Exceeded Safe Hold Time | Protect panel immediately | 1.00 | $L_{lowest}$ |
| 5 | Mid | Low | Low | Condition is ideal or returning to normal | Luminance to remain true to the HDR content | 1.00 | $L_{n+1}$ |
| 6 | Mid | Low | High | Condition is somewhat returning to normal | Luminance to slightly remain true to the HDR content | 0.25 | $L_{highest}$ |
| 7 | Mid | High | Low | Overheated | Protect panel | 0.75 | $L_{lowest}$ |
| 8 | Mid | High | High | Overheated & Exceeded Safe Hold Time | Protect panel immediately | 1.00 | $L_{lowest}$ |
| 9 | Low | Low | Low | Condition is ideal or returning to normal | Luminance to remain true to the HDR content | 1.00 | $L_{n+1}$ |
| 10 | Low | Low | High | Condition is somewhat returning to normal | Luminance to slightly remain true to the HDR content | 0.50 | $L_{mid}$ |
| 11 | Low | High | Low | Overheated | Protect panel | 0.75 | $L_{lowest}$ |
| 12 | Low | High | High | Overheated & Exceeded Safe Hold Time | Protect panel immediately | 1.00 | $L_{lowest}$ |

For instance, if all a values start out from an ideal condition, then Equation 1 applies and α may be given by $F[\alpha_{Luminance\text{-}High} + \alpha_{Temperature\text{-}Low} + \alpha_{Time\text{-}Low}]$. In this case, for example, $L_{n+1} = \alpha_{Global} \times 450$ nits$+(1-\alpha_{Global}) \times 300$ nits=375 nits.

When conditions are well-suited (e.g., temperature is well within the thermal profile and time is well within the duration to meet reliability standards), which typically occurs a majority of the time (e.g., as much as ~90% of the time, in many cases), then $\alpha_{Temperature}$ may assume its $\alpha_{Temperture\text{-}Low}$ value, and $\alpha_{Time}$ may also assume its $\alpha_{Time\text{-}Low}$ value; while $\alpha_{Luminance\text{-}High}$ ensures that the resulting luminance of the LCD display follows at least one (or all) HDR requirements.

In other circumstances, which may be influenced by environmental conditions (e.g., Temperature) and physical parameters (e.g., time and content), $\alpha_{Global}$ may be adjusted accordingly as stipulated in Table I. These values may be reflected in the feedback path of method 400. As a final stage of validation, each condition may be logically evaluated and prioritized to reach a corresponding Result.

It should be understood that various operations described herein may be implemented in software executed by logic or processing circuitry, hardware, or a combination thereof. The order in which each operation of a given method is performed may be changed, and various operations may be added, reordered, combined, omitted, modified, etc. It is intended that the invention(s) described herein embrace all such modifications and changes and, accordingly, the above description should be regarded in an illustrative rather than a restrictive sense.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A display, comprising:

a Standard Dynamic Range (SDR)-Liquid Crystal Display (LCD) panel comprising a Light-Emitting Diode (LED) backlight; and a controller coupled to the SDR-LCD panel, the controller configured to:

identify video that includes High Dynamic Range (HDR) content using a luminance histogram; and display the HDR content by increasing a luminance of the LED, wherein the video includes a first portion having luminance content below a threshold and a second portion having luminance content above the threshold, and wherein displaying the HDR content further comprises:

(a) boosting a luminance of the LED backlight to a first value while the first portion is being displayed; and (b) boosting the luminance of the LED backlight to a second value greater than the first value, for a duration shorter than the displaying of the second portion.

2. The display of claim 1, wherein boosting the luminance includes applying, to the LED backlight, an amount of electrical current above a normal operating range, wherein the amount of electrical current decreases a lifespan of the LED backlight faster than any other amount of electrical current within the normal operating range.

3. The display of claim 2, wherein boosting the luminance includes increasing the luminance by a discrete increment.

4. The display of claim 3, wherein the first portion does not include any HDR content and the second portion includes the HDR content, and wherein the discrete increment is calculated to prevent flashing or blinking of the SDR-LCD panel between the displaying of the first portion and the displaying of the second portion.

5. The display of claim 3, wherein the discrete increment produces a luminance value derived as: (a) a luminance value of a current frame multiplied by a weighted coefficient; plus (b) one minus the weighted coefficient, multiplied by a luminance value of a previous frame.

6. The display of claim 5, wherein the weighted coefficient is a combination of: a temperature-based coefficient, a scene-based coefficient, and a time-based coefficient.

7. The display of claim 1, wherein the controller is further configured to:

determine that a thermal overrun event has occurred; and decrease the luminance of the LED backlight by another discrete increment using a temperature-based coefficient while the video continues to include the HDR content.

8. The display of claim 1, wherein the controller is further configured to:

determine that an overdrive timeout event has occurred; and decrease the luminance of the LED backlight by another discrete increment using a time-based coefficient.

9. The display of claim 1, wherein the controller is further configured to:

determine that a thermal overrun event has not occurred;

determine that an overdrive timeout event has not occurred; and increase the luminance of the LED backlight by another discrete increment based on a scene-based coefficient.

10. A hardware memory device having program instructions stored thereon that, upon execution by a controller, cause the controller to:

identify video that includes High Dynamic Range (HDR) content; and display the HDR content, at least in part, by increasing an electrical current applied to an LED backlight of a Standard Dynamic Range (SDR), Liquid Crystal Display (LCD) panel, wherein the video includes a first portion and a second portion, wherein the first portion does not include any HDR content and the second portion includes the HDR content, and wherein the increase prevents flashing or blinking of the LED backlight between the displaying of the first portion and the displaying of the second portion by the SDR-LCD panel.

11. The hardware memory device of claim 10, wherein increasing the electrical current includes increasing a luminance by a discrete increment.

12. The hardware memory device of claim 11, wherein the discrete increment results in a luminance value derived as: (a) a luminance value of a current frame multiplied by a weighted coefficient; plus (b) one minus the weighted coefficient, multiplied by a luminance value of a previous frame.

13. The hardware memory device of claim 11, wherein the program instructions are further configured to cause the controller to:

determine that a thermal overrun or overdrive timeout event has occurred; and decrease the luminance by another discrete increment using a temperature-based or time-based coefficient while the video continues to include the HDR content.

14. The hardware memory device of claim 13, wherein the program instructions are further configured to cause the controller to:

determine that neither a thermal overrun nor an overdrive timeout event has occurred; and increase the luminance by another discrete increment based on a scene-based coefficient.

15. A method, comprising:

identifying, via a controller, video that includes High Dynamic Range (HDR) content;

displaying the HDR content, at least in part, by increasing a brightness of an LED backlight of a Standard Dynamic Range (SDR), Liquid Crystal Display (LCD) panel; and at least one of:

(i) determining that a thermal overrun or overdrive timeout event has occurred and decreasing the brightness by another discrete increment using a temperature-based or time-based coefficient while the video continues to include the HDR content or (ii) determining that neither the thermal overrun nor the overdrive timeout event has occurred and increasing the brightness by another discrete increment based on a scene-based coefficient.

16. The method of claim 15, wherein increasing the brightness includes increasing a luminance by a discrete increment.

17. The method of claim 16, wherein the discrete increment results in a luminance value derived as: (a) a luminance value of a current frame multiplied by a weighted coefficient; plus (b) one minus the weighted coefficient, multiplied by a luminance value of a preceding frame.

18. A method, comprising:

identifying, via a controller, video that includes High Dynamic Range (HDR) content; and displaying the HDR content, at least in part, by increasing a brightness of an LED backlight of a Standard Dynamic Range (SDR), Liquid Crystal Display (LCD)

panel by an increment, wherein increment results in a luminance given by: (a) a luminance value of a current frame multiplied by a weighted coefficient; plus (b) one minus the weighted coefficient, multiplied by a luminance value of a preceding frame.

* * * * *